US006353950B1

(12) United States Patent
Bartlett et al.

(10) Patent No.: US 6,353,950 B1
(45) **Date of Patent: *Mar. 12, 2002**

(54) POSITIONAL FEEDBACK SYSTEM FOR MEDICAL MATTRESS SYSTEMS

(75) Inventors: Alan L. Bartlett, New Braunfels; Randall Ohman, San Antonio, both of TX (US)

(73) Assignee: Kinetic Concepts, Inc., San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/679,135

(22) Filed: Jul. 12, 1996

Related U.S. Application Data

(63) Continuation of application No. 08/241,075, filed on May 9, 1994, now Pat. No. 5,611,096.

(51) Int. Cl.[7] ..... A61G 7/00
(52) U.S. Cl. ..... 5/617; 5/615; 5/609; 5/713
(58) Field of Search ..... 5/607, 609, 615, 5/617, 424, 710, 711, 713, 714, 715, 914

(56) References Cited

U.S. PATENT DOCUMENTS 4,628,556 A * 12/1986 Blackman ..... 5/424
4,761,000 A * 8/1988 Fisher et al. ..... 5/608
4,769,584 A * 9/1988 Irigoyen et al. ..... 5/424 X
4,949,413 A * 8/1990 Goodwin ..... 5/713
5,044,029 A * 9/1991 Vrzalik ..... 5/713
5,181,288 A * 1/1993 Heaton et al. ..... 5/914 X
5,611,096 A * 3/1997 Bartlett et al. ..... 5/715 X

* cited by examiner

*Primary Examiner*—Michael F. Trettel
(74) *Attorney, Agent, or Firm*—Wayne J. Colton, Inc.

(57) ABSTRACT

An apparatus adjusts the pressures of a therapeutic mattress surface in accordance with the angular position of that surface. The apparatus comprises an angular position sensor and a rotation sensor which are housed together in an enclosure having a top surface in the form of a circular plate. The circular plate mounts either on the surface of the mattress or on the bottom of a bed frame supporting the mattress. The angular position and rotation sensors measure the horizontal plane referenced perpendicular to the direction of the force of gravity. The apparatus further comprises a controller blower valve assembly which processes data received from the angular position and rotation sensors to maintain, increase, or decrease the pressures within the mattress.

20 Claims, 12 Drawing Sheets

POSITIONAL FEEDBACK SYSTEM FOR MEDICAL MATTRESS SYSTEMS

This application is a continuation of Ser. No. 08/241,075 filed May 9, 1994 now U.S. Pat. No. 5,611,096.

BACKGROUND OF THE INVENTION

1. Field of the Invention

The present invention relates to methods and apparatus for monitoring and/or controlling therapeutic beds and mattress systems and the patients supported thereon. More particularly, the invention relates to monitoring angular deviations of the mattress surface and patient from the flat, horizontal position and for controlling the system in response.

2. Description of Background Art

Therapeutic supports for bedridden patients have been well known for many years. Well known therapeutic supports include (without limitation) low air loss beds, lateral rotation beds and fluidized bead beds. Commercial examples are the "KinAir", "RotoRest" and "FluidAir" beds, all of which are products manufactured and commercialized by Kinetic Concepts, Inc. of San Antonio, Tex. Similar beds are described in U.S. Pat. Nos. 4,763,463, 4,175,550 and 4,635,564, respectively.

Other examples of well-known therapeutic supports for bedridden patients are the inflatable mattresses, mattress overlays or mattress replacements that are commercialized independent of a rigid frame. Because of the simpler construction of these products separate from a costly rigid frame, they tend to be more versatile and economical, thereby increasing options for customers and allowing them to control costs. A specific example of one such mattress is the "TheraKair" mattress, described in U.S. Pat. No. 5,267,364, dated Dec. 7, 1993, also manufactured and commercialized by Kinetic Concepts, Inc. The TheraKair mattress is a composite mattress including a plurality of transversely-oriented inflatable support cushions that are controlled to pulsate and to be selectively adjustable in groups.

Most therapeutic mattresses are designed to reduce "interface pressures", which are the pressures encountered between the mattress and the skin of a patient lying on the mattress. It is well known that interface pressures can significantly affect the well-being of immobile patients in that higher interface pressures can reduce local blood circulation, tending to cause bed sores and other complications. With inflatable mattresses, such interface pressures depend (in part) on the air pressure within the inflatable support cushions. Although a number of factors are at play, as the cushion's air pressure decreases, the patient interface pressure also tends to decrease, thereby reducing the likelihood that the patient will develop bedsores and other related complications. Hence the long-felt need to have an inflatable mattress which optimally minimizes the air pressure in the inflated cushions.

The desired air pressure within a given cushion or group of cushions may also depend on inclination of the patient support, or portions thereof. For instance, it is known that when the head end of a bed is raised, a greater proportion of the patient's weight tends to be concentrated on the buttocks section of the mattress. Hence, it has long been known to divide inflatable therapeutic mattresses into groups of transversely-oriented inflatable cushions corresponding to different regions of patient's body, with the pressure in each group being separately controlled. Then, when a patient or attendant controls the bed to elevate the patient's head, pressure in the buttocks cushions is automatically increased to compensate for the greater weight concentration and to prevent bottoming of the patient. ("Bottoming" refers to any state where the upper surface of any given cushion is depressed to a point that it contacts the lower surface, thereby markedly increasing the interface pressure where the two surfaces contact each other.)

It is also well known in the field of treating and preventing bedsores, that therapeutic benefits may be obtained by raising and lowering (or "pulsating") the air within various support cushions. The effectiveness of this therapy may be reduced or negated if the surface inclination of a region (i.e., angle of the region relative to a horizontal plane) changes, or if the pressure in the appropriate support cushions is not properly adjusted. As with bottoming, such a condition may occur when the head of the patient is raised to facilitate, for example, feeding of the patient. As the angle of the head end of the support mattress (and thus the angle of patient's head) becomes greater, the patient's weight redistributes. Consequently, a greater proportion of the patient's weight is concentrated on the patient's buttocks region, while less weight is concentrated on the head and back region.

It is also known to subject patients to gentle side-to-side rotation for the treatment and prevention of pulmonary problems. It is known to achieve such rotation therapy by alternating pressure in two inflatable bladders which are disposed longitudinally under the support mattress along the length of the left and right sides of the patient. Consequently, as one of the inflatable bladders inflates, the patient rotates by an angle up to approximately 45 degrees. Although references such as RWM's U.S. Pat. No. 4,769,584 have long taught the importance of sensing the actual angle of rotation, the actual rotation angle in inflatable supports was typically controlled by the amount of pressure applied to the pivot bladder without measuring the actual angle of rotation attained. Unfortunately, during this treatment, if too great of a rotation angle is achieved, then the patient tends to roll to the edge of the support mattress as one of the inflatable bladders inflates. Therefore, if an apparatus could be designed which would measure and control rotation angles of the therapeutic bed surface this would prevent attaining excess angles resulting in the patient rolling to the edge of the support mattress during side-to-side alteration, and possibly falling off the support mattress. Also, if a minimum rotation angle of about twenty five degrees is not attained, then minimal or no therapeutic value is received by the patient.

It has also long been known in the art to control other aspects of the patient surface in response to inclination of specific portions of the patient. For instance, the Eggerton "Tilt and Turn" bed popular in the 1980's was adapted to raise a restraining portion of the patient surface during lateral turning, in order to help prevent the patient from rolling off the bed. Another example is the automatic knee gatch feature popularized in Hill-Rom frames, particularly such as described in U.S. Pat. No. 3,237,212. Such knee gatch feature was adapted to automatically raise the knee section of the patient support whenever the patient or caregiver desired to raise the head section, hence compensating to prevent a patient from sliding toward the foot end of the bed when the head section was raised.

The concept of controlling air pressure inflatable support cushions in response to changes in the patient surface is at least plausible in bed systems which utilize a rigid frame structure beneath the patient. The frame structure provides an attractive location for mounting the transducers required for such control. With flexible mattresses, to position any foreign devices in closer proximity to a patient, because a patient might be injured by contact with the device would be steadfastly avoided, mounting a sensor to a rigid base board helps shield a patient from contact with the sensor. The result, though, is that a health care facility is inclined to acquire the entire bed system in order to gain the benefits of such technology—an acquisition which may not be readily affordable. Such acquisitions also limit the health care facility to using specific mattresses with specific frames, rather than separately selecting and interchanging the preferred mattresses and bed frames. Interchangeability, on the other hand, would tend to maximize the facilities cost containment and efficiency.

Unfortunately, conventional support mattresses fail to properly adjust the pressure within the support cushions as the surface angles of the support mattress vary. Therefore, if an apparatus could be implemented which would adjust the pressure within the support cushions as the mattresses surface angles change, the pressure points on the patient would be significantly reduced, thereby preventing or significantly reducing the number of bedsores.

Others have taught that the desired air pressure within the air cushions may depend in part on the angle to which the patient is desired to be rotated. For instance, U.S. Pat. No. 5,003,654 dated Apr. 2, 1991 described an oscillating low air loss bed which laterally rotates a patient to varying degrees depending in part on the pressure within the cushions which achieve the turn.

SUMMARY OF THE INVENTION

The present invention comprises a new and improved apparatus for measuring the angular positions of a therapeutic mattress surface and adjusting the pressures within the mattress in accordance with the angular position, and providing feedback to control rotation angles attained by the therapeutic mattress. The apparatus is particularly suited for use with a therapeutic mattress which comprises a plurality of inflatable support cushions positioned latitudinally under the patient's body. Typically, such a mattress is divided into four regions: The head region, the back region, the buttock region, and the legs/feet region. Furthermore, the mattress comprises two inflatable guard rails, each positioned on either side of the patient on the mattress surface.

The apparatus comprises an angular position sensor and a rotation sensor which are housed together in an enclosure having a top surface in the form of a circular plate. The circular plate mounts either on the surface of the mattress between two cushions or on the bottom of a bed frame supporting the mattress. The angular position and rotation sensors measure the angular position of the mattress's surface in relation to the horizontal and vertical planes, respectively.

The apparatus further comprises a controller which typically mounts on the bed frame. The controller processes the data received from the angular position and rotation sensors to maintain, increase, or decrease, when necessary, the pressure within the appropriate cushions of the mattress, the pivot bladders, or the inflatable guard rails.

It is, therefore, an object of the present invention to provide a feedback signal to a controller of a therapeutic mattress surface, on which a patient is receiving therapy, to cause compensations in the support surface pressures corresponding to changes in mattress surface angles.

Another object of the present invention is to provide an apparatus which measures and adjusts the pressure within the support cushions of the therapeutic mattress in relation to the changes in the mattresses surface angles. Such an apparatus may significantly reduce the prevalence number of bedsores. Another object is to provide an apparatus that measures and displays the rotation angle of a therapeutic bed surface to help prevent the patient from rolling to the edge of the support mattress during side-to-side alteration. Still another object is to control such rotation in response to current measurement, for various purposes. Such a system may help preclude the patient from falling off the support mattress, while ensuring that adequate rotation angles were achieved to provide the patient proper therapy.

It is still another object of the present invention to provide a feedback signal to the controller corresponding to changes in the rotation angle of the mattress surface to facilitate pressure compensations in the inflatable guard rails and to control the amount of rotation angle achieved by causing adjustments of pressures in the pivot bladders.

Another object of the present invention is to provide controlling feedback to the mechanism which adjust pressures in inflatable bladders located such as to cause side to side rotation of the therapeutic bed surface.

These and other objects, features, and advantages of the present invention will become evident to those skilled in the art in light of the following brief description of the drawings and detailed description.

DETAILED DESCRIPTION OF THE PREFERRED EMBODIMENTS

Therapeutic bed 10, as described herein, is an example of a presently preferred embodiment of the present invention.

Figure 1:
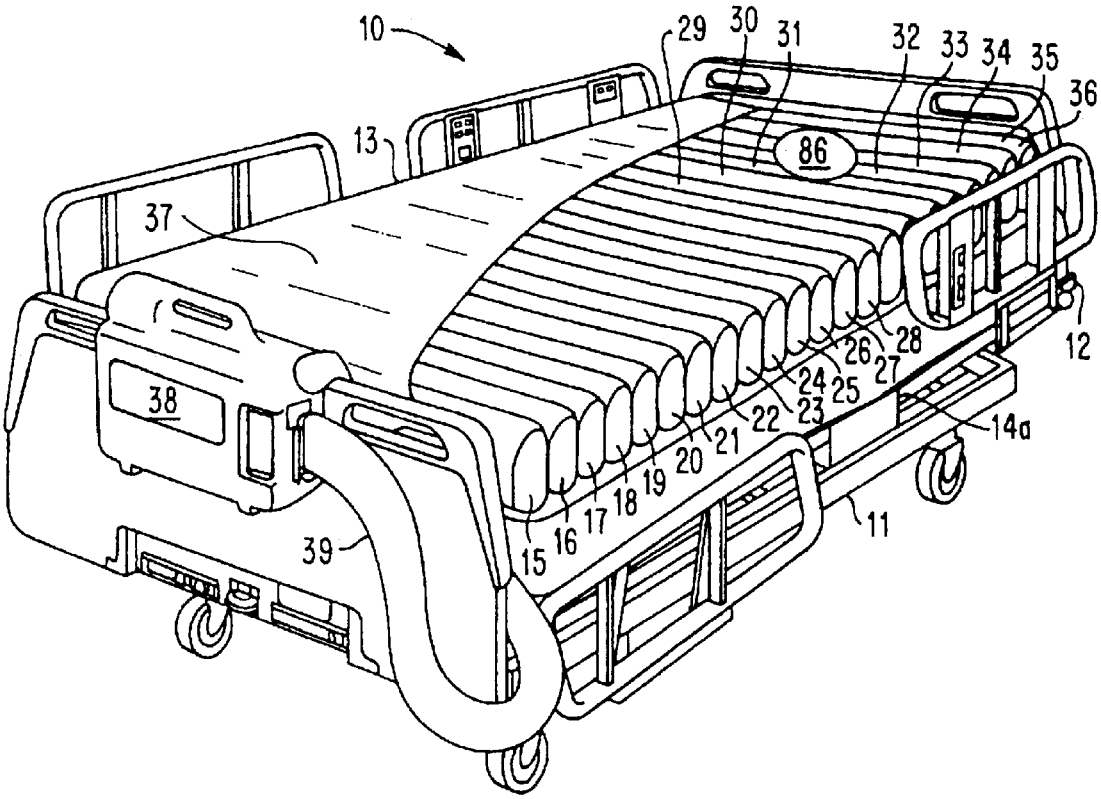
FIG. 1 is a perspective view depicting a therapeutic bed 10 having a preferred embodiment of the present invention mounted thereon.
Figure 2:
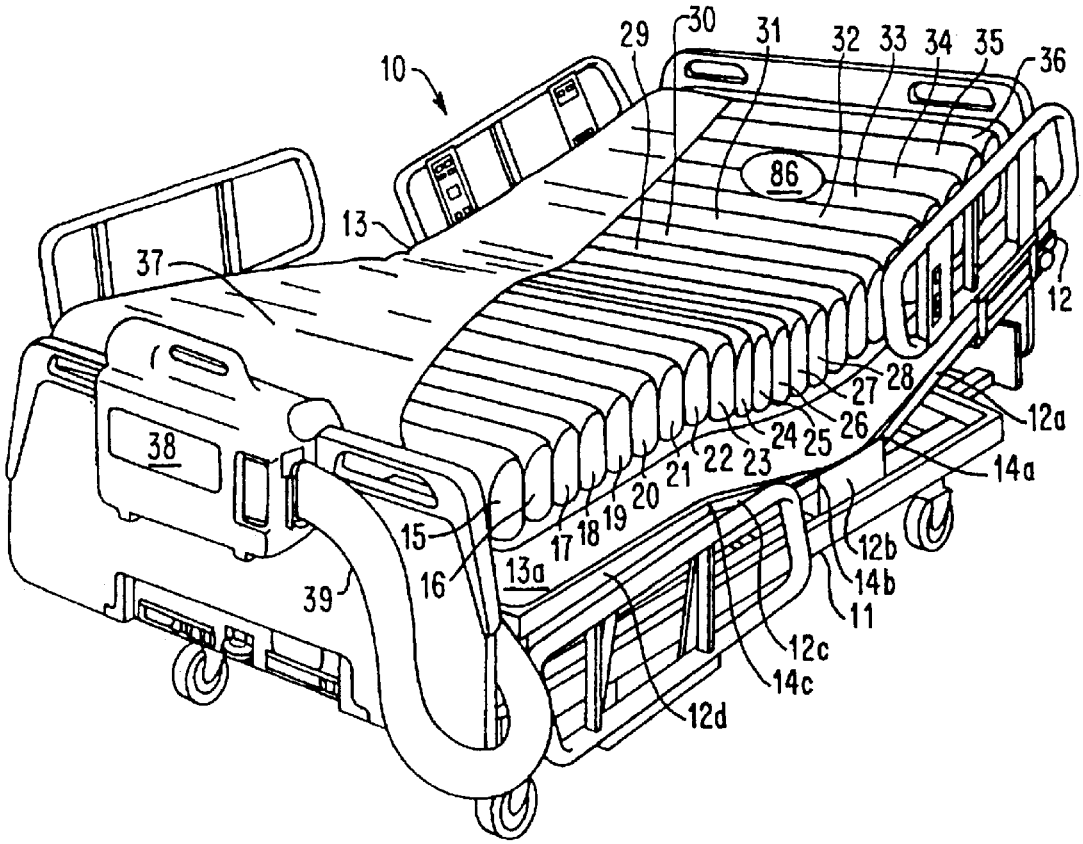
FIG. 2 is a perspective view off the therapeutic bed 10 of FIG., with its head section in an elevated position.

As illustrated generally in FIGS. 1 and 2, therapeutic bed 10 comprises mattress 13, control unit 38, and frame 11.

Frame 11 in the illustrated embodiment is a conventional hospital bed frame. More particularly, frame 11 is commercially available through Amedco Health Care, Inc., of Wright City, Mo. under the designation "Futura Series Bed," Model No. 2110. Such frames are equipped with conventional raise-and-lower mechanisms and sit-up mechanisms for adjusting the position of the patient surface.

Frame 11 includes sub-frame 12, which is the portion of frame 11 that directly supports mattress 13. As will be evident from viewing the frame itself, sub-frame 12 is subdivided into four sections 12*a*–12*d*. More particularly, section 12*a* is the head section of sub-frame 12, section 12*b* is the buttock section of sub-frame 12, section 12*c* is the thigh section of sub-frame 12, and section 12*d* is the foot section of sub-frame 12. Sections 12*a*–12*d* are pivotally linked (or "hinged") to one another at pivot joints 14*a*–14*c* to form an articulatable mattress support system, which supports mattress 13. Subframe 12*b* is actually fixed relative to the remainder of frame 11, whereas sections 12*a* and 12*c* are pivotable relative to section 12*b*, with section 12*a* pivoting about pivot joint 14*a*, and section 12*c* pivoting about joint 14*b* relative to section 12*b*. Section 12*d*, in turn, pivots relative to section 12*c* about pivot joint 14*c*. Pivot joints 14*a*–*c*, together with opposite pivot joints (not shown) which correspond to pivot joints 14*a*–14*c* along the opposite side of subframe 12, provide three, mutually-parallel pivot axes about which sections 12*a, c* and *d* pivot. Each of said sections 12*a*–12*d* in the preferred embodiment are conventionally adapted with sheet metal (or "pan") surfaces spanning across the width of subframe 12. The pan surface of each of sections 12*a*–12*d* may be referred to as the "baseboard" of the respective section.

Frame 11 is equipped with a conventional drive device (not shown), such as a combination of electric motors together with mechanical linkage, for enabling elevation and articulation (i.e. angular movement) of sub-frame 12 relative to the horizontal. Conventional controls for such lifting device allow a user of bed 10 to raise and lower the entire sub-frame 12 and/or to articulate the mattress supporting surface of sub-frame 12. "Articulation" of sub-frame 12 includes raising or lowering head section 12*a* relative to buttock section 12*b* and/or raising or lowering of thigh and foot sections 12*c* and 12*d* relative to buttock section 12*b*. All such features of frame 11 are standard features with conventional hospital bed frames.

Other commercially available hospital bed frames may also be employed. For instance, in another embodiment of the present invention, the frame utilized is one manufactured by Stryker Medical of Kalamazoo, Mich. under the designation "Renaissance Series, Dual Control Critical Care Bed".

Referring again to the embodiment shown in FIG. 1, mattress 13 comprises a foam submattress (or "pad") 13*a*, a plurality and inflatable tubular elements (or "cushions" or "air bags") enclosed by cover 37. Although certain details of the construction of mattress 13 are described here in detail, it will be evident that many details are not critical to the present invention. Various alternative constructions will be evident from the description of U.S. Pat. No. 5,168,589, entitled "Pressure Reduction Air Mattress and Overlay", dated Dec. 8, 1992, as well as from a viewing or incorporation of various products commercialized by Kinetic Concepts, Inc. of San Antonio, Tex., including those marketed under the designations "DynaPulse", "TheraKair", "FirstStep", and "Homekair DMS". All in a construction generally like U.S. Pat. No. 5,267,364, entitled "Therapeutic Wave Mattress", dated Dec. 7, 1993.

Figure 7D:
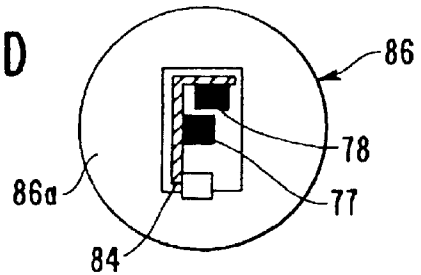
FIG. 7D shows a detailed portion of the illustration in FIG. 7A.
Figure 7C:
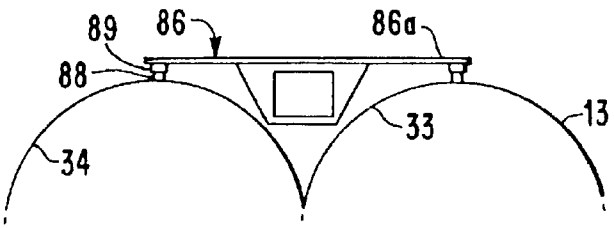
FIG. 7C shows a detailed portion of the illustration in FIG. 7B.
Figure 7B:
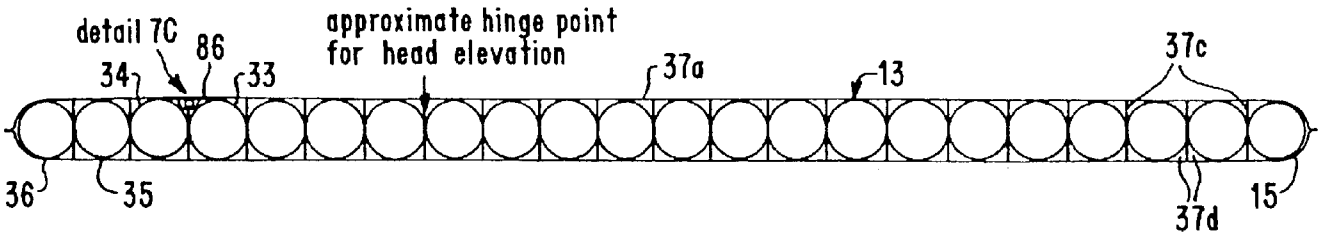
FIG. 7B is a side elevation view depicting the mounting of the angular position and rotation sensors of the preferred embodiment onto the therapeutic mattress 13.
Figure 7A:
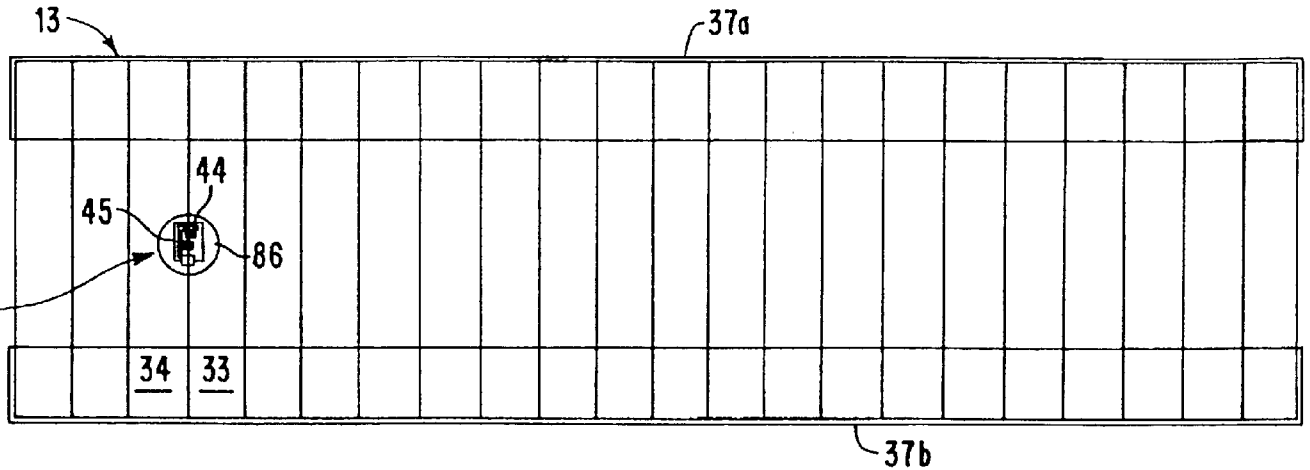
FIG. 7A is a top view depicting the mounting of the angular position and rotation sensors of the preferred embodiment onto the mattress 13.

In the presently preferred embodiment of mattress 13, cover 37 contains inflatable support cushions 15–36. Although not pictured in FIG. 1, cover 37 may be accompanied by opposite retaining sleeves 37*a*, 37*b* (FIGS. 7A & 7B) for positioning cushions 15–36. Each sleeve 37*a*, 37*b* includes twenty-one vertical baffles that divide cover 37 into twenty-two individual pockets 37*d* which each receive an end of one of cushions 15–36 to form mattress 13. Each of such baffles 37*c* are formed integrally with the respective sleeve 37*a*, 37*b* by means of sewing the baffles 37*c* in the desired orientation. Such a construction is like that used in the commercially available "DynaPulse" product marketed by Kinetic Concepts, Inc. of San Antonio, Tex. Such a construction has the benefit of leaving the central region of mattress 13, where sensor enclosure 86 is located, free of baffles so that sensor enclosure 86 can be mounted directly to the air cushions 33 and 34. Various alternative constructions for sleeve 37*a* and 37*b* will be evident to those of ordinary skill in the art. For instance, a sleeve may be centrally oriented in mattress 13, with each of the opposite ends of cushions 15–36 extending beyond the lateral limits of such a sleeve. Cover 37 may also include zippers and/or a releasable Velcro-like flap to help seal cushions 15–36 within their respective pockets. Such a flap may seal to the body of cover 37 using any suitable means.

Cushions 15–36 are arranged into four body support regions: the head region, the back region, the buttock region, and the leg/foot region. Illustratively, cushions 33–36 form the head region, cushions 29–32 form the back region, cushions 23–28 form the buttock region, and cushions 15–22 form the leg/foot region.

Control unit (or "controller") 38 includes the components for inflating and controlling mattress 13, and for interfacing with patient caregiver. As will be evident to those of ordinary skill in the art, such components (not shown) include a blower, a microprocessor or the equivalent, a heater, various valves and an equal number of pressure sensors, manifolds, connections, and insulation in such manner as may be desired. Controller 38 has a housing adapted with adjustable hooks for mounting on the footboard or siderail of frame 11. Control unit 38 connects to each one of cushions 15–36 via a plurality of fluid lines (not shown) contained within trunk line 39 to supply cushions 15–36 with air as an inflating medium. Other inflating medium such as water will be evident to those of ordinary skill in the art. The fluid lines connect to their respective cushions using any suitable means such as a quick connect valve that includes a male member having a flange and a female member having a cavity about its inner surface for receiving the flange. Trunk line 39 enters cover 37 through an opening (not shown) to allow each individual fluid line to communicate the inflating medium to the cushions. Cushions 15–36 each include a cut-out portion (not shown) at their lower end on one side of mattress 13 to provide space for trunk line 39 to run through cover 37. Although those of ordinary skill in the art will understand conventional means of connecting fluid lines to cushions 15–36 in the preferred embodiment, description of the fluid connections pictured in FIG. 11 may be of further assistance in such understanding.

Figure 3:
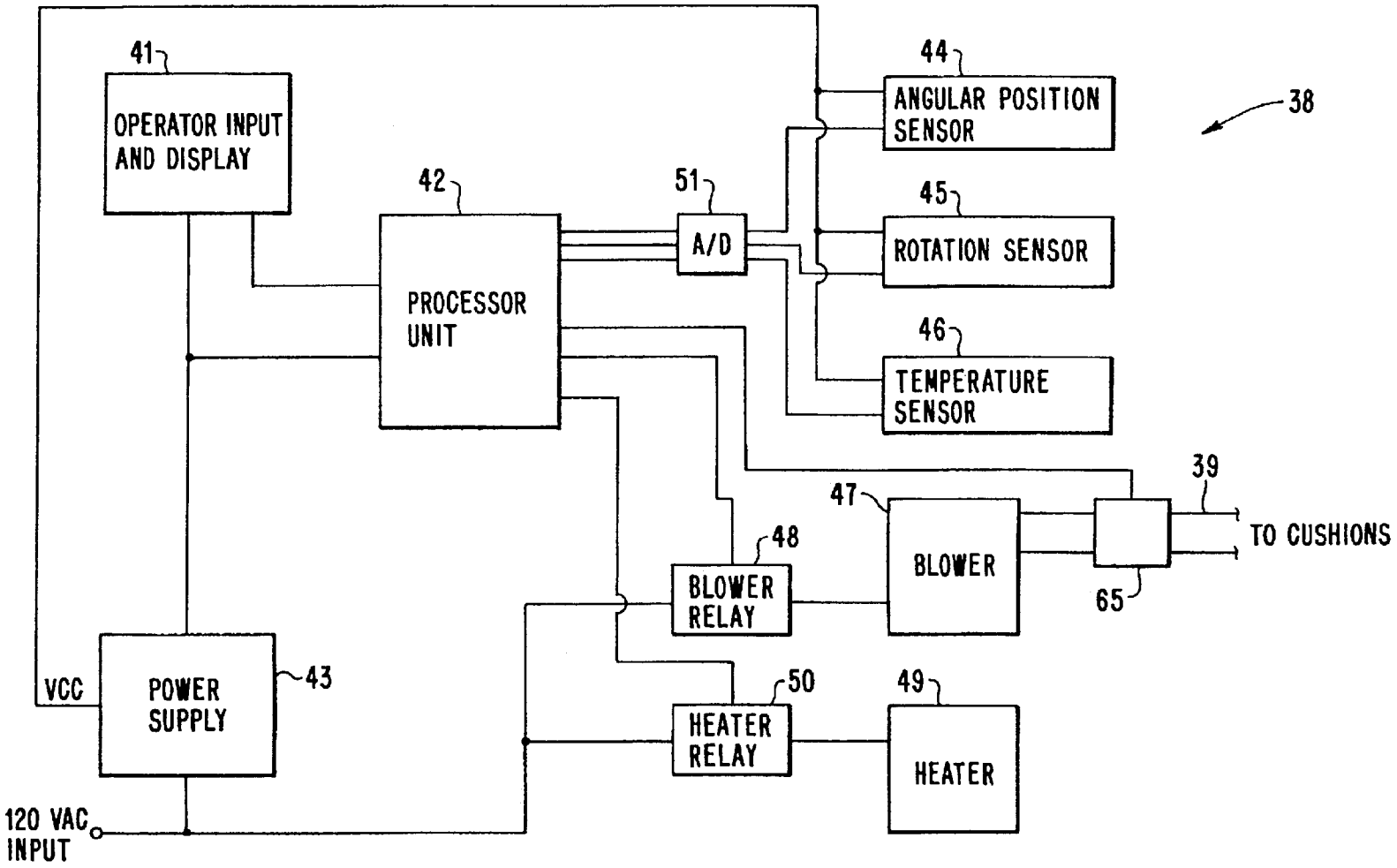
FIG. 3 is a diagram depicting the control system 38 of the preferred embodiment.

Referring to FIG. 3, controller 38 comprises operator input and display 41, processor unit 42, power supply 43, angular position sensor 44, rotation sensor 45, temperature sensor 46, blower 47, blower relay 48, heater 49, heater relay 50, analog to digital (A/D) converter 51, and air controller valve bank 65. Controller 38 connects to any suitable power source such as a 120 VAC public power line, preferably via a "hospital grade" outlet. Power supply 43 receives the 120VAC input and converts it into a standard 5 VDC suitable for use by both processor 42 and operator input and display 41. Power supply 43 also furnishes power to angular position sensor 44, rotation sensor 45, and temperature sensor 46. Processor unit 42 comprises a microprocessor having associated RAM and ROM.

Figure 4:
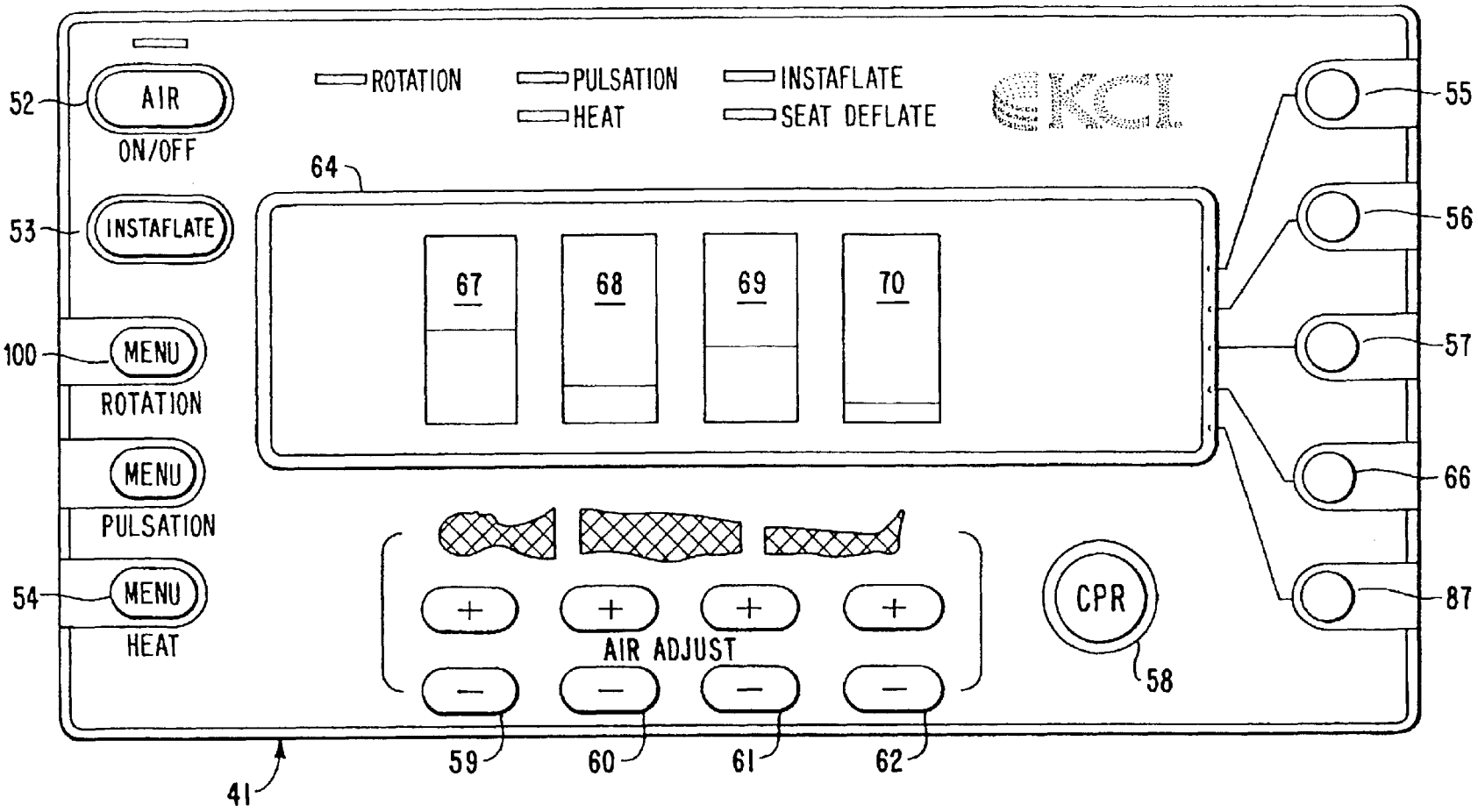
FIG. 4 is a front elevation view depicting the operator input and display of the preferred embodiment of the present invention.

As illustrated in FIGS. 3 and 4, operator input and display 41 includes ON/OFF button 52 which allows a user to control power delivery to controller 38. Upon the initial application of power, display 64 indicates that air is switched off. When the on/off button 52 is depressed, processor unit 42 generates a control signal that activates blower relay 48, resulting in blower relay 48 delivering the 120 VAC input signal to blower 47. Processor unit 42 also generates control signals that energize each air control valve in air control valve bank 65 to allow blower 47 to inflate each of cushions 15–36. Air control valve bank 65 comprises 8 air control valves corresponding at least in part to the segregation of sections of cushions forming mattress 13.

CPR button 58 provides the user with the option of automatically and completely deflating each of cushions 15–36. If the user presses CPR button 58, processor unit 42 deactivates blower relay 48 and generates control signals that energize each air control valve in air control valve bank 65 such that the individual air control valves open the fluid lines to the atmosphere. Consequently, the inflating medium in each of cushions 15–36 escapes to the atmosphere. Once cushions 15–36 vent their inflating medium to the atmosphere, processor unit 42 restores the valves in air control valve bank 65 to their previous settings.

Buttons 55, 56, 57, 58, 66 and 87 are soft keys whose functions are defined by text on the display to their left. Immediately following power up and depression of on/off button 52, the label HT/WT appears next to button 57.

Height/weight (HT/WT) button 57 permits the user to enter the height and weight of the patient 200 using therapeutic bed 10. After the user presses HT/WT button 57, the display shows test as follows: WT INCREASE next to button 55, WT DECREASE next to button 56, HT INCREASE next to button 57, HT DECREASE next to 66, and ENTER next to 87. The user enters. the height of patient 200 by pressing adjust buttons 55 and 56 until LCD 64 displays the correct height. The user enters the weight of patient 200 by pressing adjust buttons 57 and 66 until LCD 64 displays the correct weight. When LCD 64 displays the correct height and weight, the user presses save button 87 to store the patient's weight in processor unit 42. Processor unit 42 utilizes the patient's height and weight to properly regulate the pressure of the inflating medium within cushions 15–36. Illustratively, persons having smaller statures require lower pressures of the inflating medium within cushions 15–36, while patient's having larger statures require greater pressures.

Pressure adjust buttons 59–62 provide the user with control over the pressure of inflating medium within the head region, the back region, the buttock region, and the leg/foot region of mattress 13. During sustained operation, processor unit 42 displays bar graphs 67–70 on LCD 64 to provide the user with a visual indication of the inflating medium pressure in each region. Bar graphs 67–70 allow the user to quickly and easily determine which of the regions must be adjusted. Illustratively, to increase the inflating medium pressure within the head region, the user presses the plus side of pressure adjust button 59. That pushing of pressure adjust button 59 furnishes processor unit 42 with a signal to indicate that pressure should be increased in the head section cushions. In response, processor unit 42 generates a control signal that increases the opening of valves corresponding to the head section in air control valve bank 65.

Alternatively, to decrease the inflating medium pressure within the head region, the user presses the minus side of pressure adjust bottom 59. That pushing of pressure adjust button 59 furnishes processor unit 42 with a signal to indicate that a portion of the inflating medium within the head region should be vented to the atmosphere. Consequently, processor unit 42 generates control signals that energize only the air control valves in air control valve bank 65 which are connected to the fluid lines communicating with cushions 33–36. Those air control valves open the fluid lines so that the inflating medium in the head section cushions 22–26 escapes to the atmosphere. Once cushions 33–36 vent their inflating medium to the user selected pressure, processor unit 42 deactivates the activated air control valves. Pressure adjust buttons 60–62 operate identically to pressure adjust button 59 to either increase or decrease the pressure of the inflating medium within their respective body regions.

Notwithstanding that manual control of the inflating medium pressure within the body regions defined by cushions 15–36 provides the user with significant flexibility, processor unit 42 is adapted to perform the more important task of automatically adjusting such pressure. Particularly, the inflating pressure within the body regions is adjusted to compensate for weight shifts due to a changed body orientation commensurate with angular adjustment of the position of mattress 13. For instance, as mattress 13 pivots from the position shown in FIG. 1 to the position shown in FIG. 2, a patient 200 on therapeutic bed 10 will shift such that a larger portion of his body weight resides over the buttock region. To counter that shift, the pressure of the inflating medium within the buttock region (i.e., cushions 22–28) is increased while the pressure within the back regions (i.e., cushions 29–32) is decreased. The above is reversed if mattress 13 pivots from the position shown in FIG. 2 to the position shown in FIG. 1.

Figure 8:
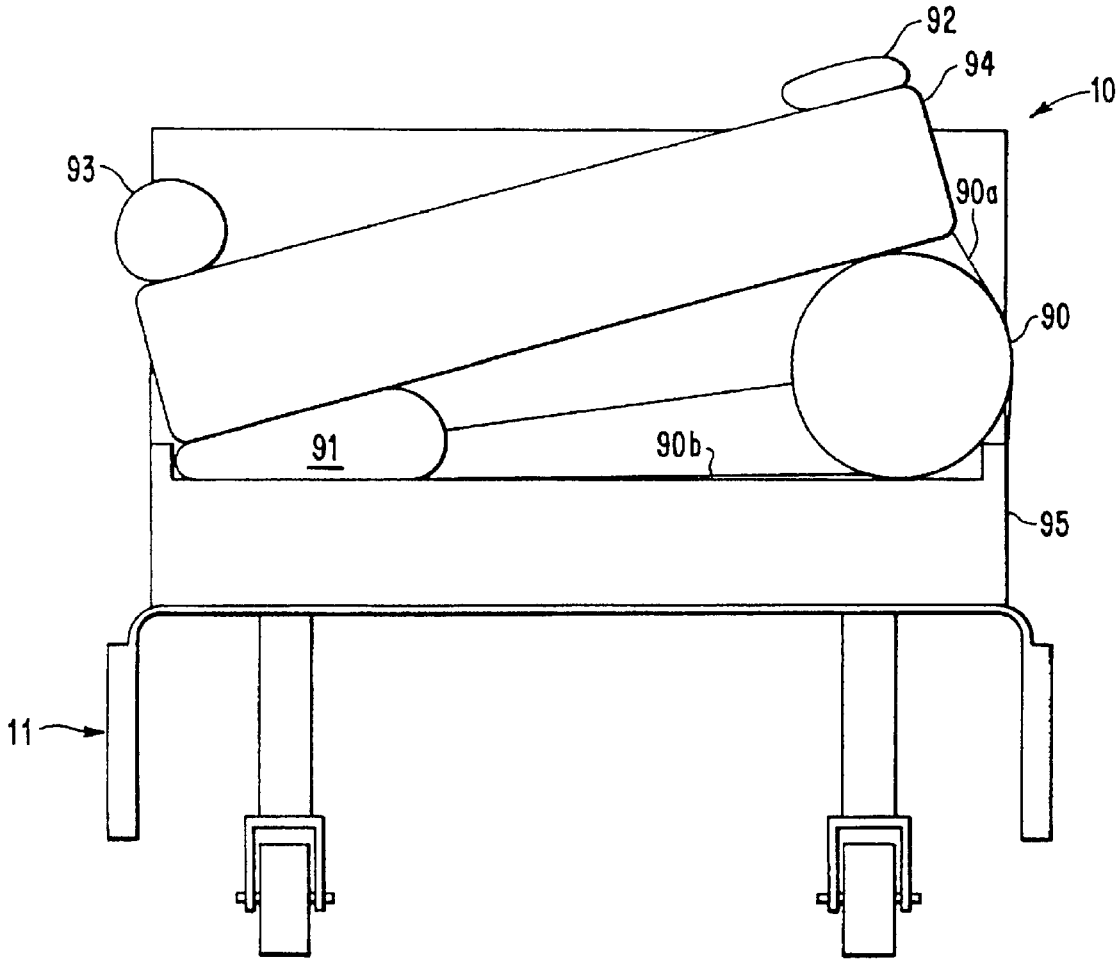
FIG. 8 is an end-on schematic elevation view, taken in cross-section, depicting the rotation bladders 90, 91 and guard bladders 92, 93 of the preferred embodiment.

As shown in FIG. 3, controller 38 includes angular position sensor 44 to furnish processor unit 42 with a signal representing the incline of mattress 13 so that processor unit 42 may automatically adjust the inflating medium pressure within each body region. Controller 38 further includes rotation sensor 45 which supplies processor unit 42 with a signal representing the rotation of mattress 13. With such signal, controller 38 can determine the current angle of lateral rotation of mattress 13 and, hence, a patient 200 lying thereon. Once determined, such angle can be output by controller 38 via an appropriately-adapted display 64, such as a digital or graphical representation thereon. Other uses of such output may also be employed, including feedback control of blower unit 38 and/or bed frame 11. More particularly, processor unit 42 may automatically adjust the inflation medium pressures within guard rails 92–93 positioned longitudinally at each side of mattress 13 and pivot bladders 90–91 positioned longitudinally underneath mattress 13 along each side as shown in FIG. 8.

Figure 6:
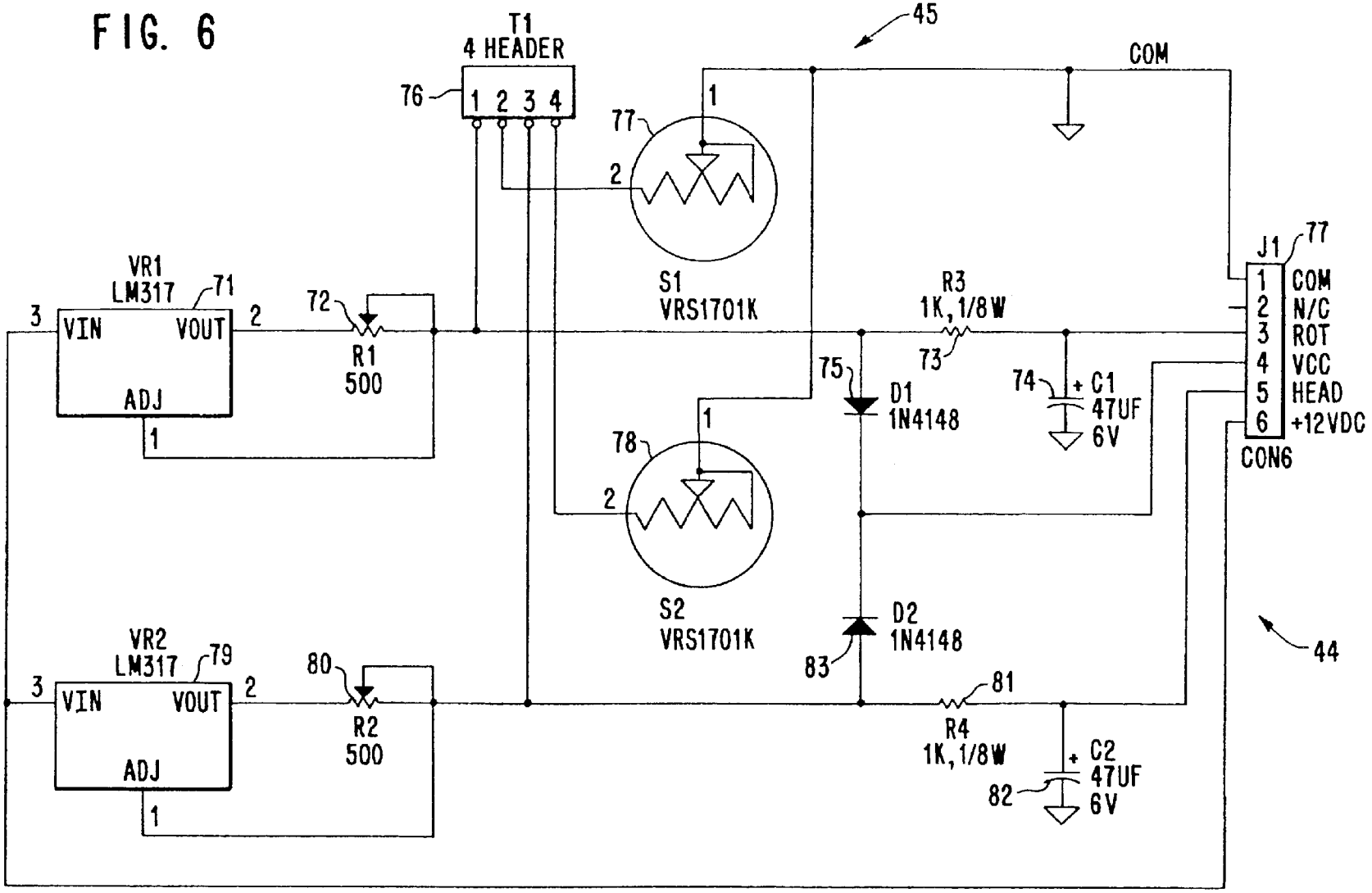
FIG. 6 is a schematic diagram depicting the wiring of the angular position and rotation sensors of the preferred embodiment.

Referring to FIG. 6, angular position sensor 44 comprises inclinometer 77, voltage regulator 71, variable resistor 72, resistor 73, capacitor 74, and diode 75. Inclinometer 77 comprises a resistive element that changes value as inclinometer 77 rotates from a horizontal to an angular position.

Voltage regulator 71 is configured as a current source to supply the current to inclinometer 77 which ultimately becomes the output signal from angular position sensor 44. Variable resistor 72 establishes the output current from voltage regulator 71 and, further, provides a calibration adjustment for position sensor 44 that allows a user to normalize the relationship between the current produced from voltage regulator 71 relative to the ratio of change in resistance verses change in angular position of inclinometer 77. Resistor 73 and capacitor 74 form a dampening filter to remove spurious transient outputs from inclinometer 77, while diode 75 limits the output voltage of inclinometer 77 to the bias voltage received from power supply 43. Header 76, having pins 1 shorted to 2 and 3 shorted to 4 in normal operation, allows the disconnection of inclinometer 77 during the calibration of angular position sensor 44. Connector 77 provides the electrical connection of angular position sensor to controller 38.

Rotation sensor 45 comprises inclinometer 78, voltage regulator 79, variable resistor 80, resistor 81, capacitor 82, and diode 83. Inclinometer 78 comprises a resistive element that changes value as inclinometer 78 rotates about a central horizontal axis. Voltage regulator 79 is configured as a current source to supply the current to inclinometer 78 which ultimately becomes the output signal from rotation sensor 45. Variable resistor 80 establishes the output current from voltage regulator 79 and, further, provides a calibration adjustment for rotation sensor 45 adjustment that allows a user to normalize the relationship between the current produced from voltage regulator 79 relative to the ratio of change in resistance verses change in angular position of inclinometer 78. Resistor 81 and capacitor 83 form a dampening filter to remove spurious transient outputs from inclinometer 78, while diode 83 limits the output voltage of inclinometer 78 to the bias voltage received from power supply 43. Header 76, having pins 1 shorted to 2 and 3 shorted to 4 in normal operation, allows the disconnection of inclinometer 78 during the calibration of rotation sensor 45, while connector 77 provides the electrical connection 45 of rotation sensor 45 to controller 38.

It has also been found that the tilt angle sensed by sensor 45 and the sit-up angle sensed by sensor 44 provide angular measurements relative to an imaginary vertical plane oriented along the longitudinal axis of bed 10. The therapeutic objective, rather than determine the degree of rotation relative to such axis, is to determine the degree of rotation relative to the base board supporting the head section of mattress 13. To achieve this objective, the sit-up angle is utilized in an algorithm to translate the angle measured by the tilt sensor from the universal coordinates of the earth to the coordinates of the base board of head section 12*a*. The details of such algorithm will be evident to those of ordinary skill in the art.

Figure 5:
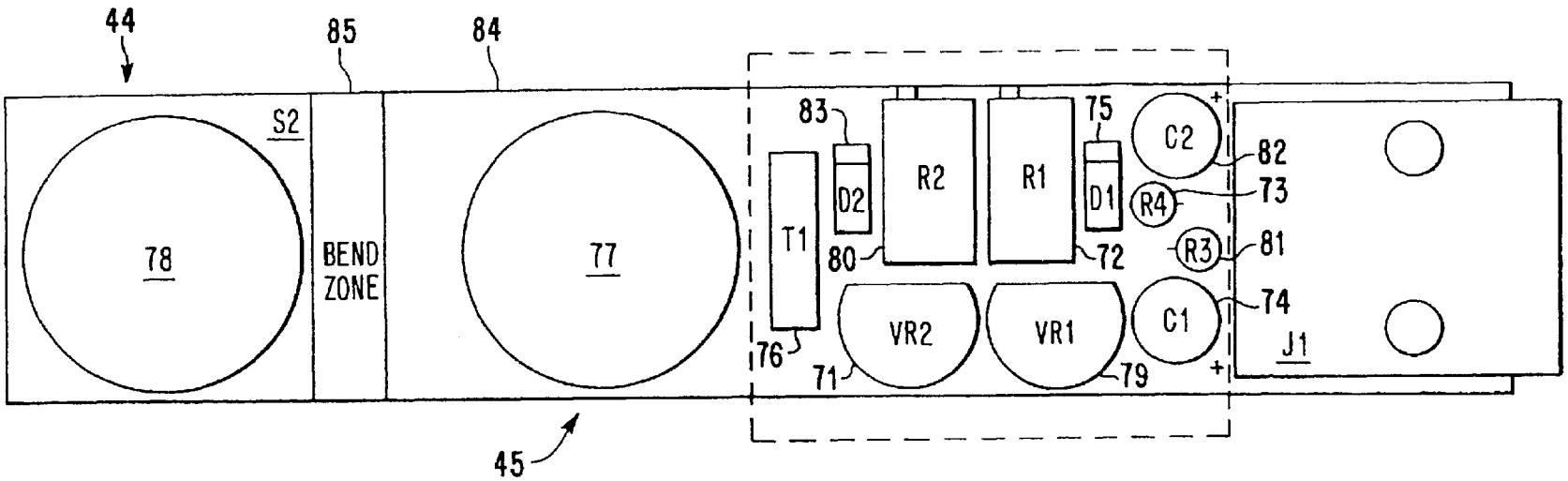
FIG. 5 is a diagram depicting the mounting of the angular position and rotation sensors of the preferred embodiment on a circuit board.

As illustrated in FIG. 5, angular position sensor 44 and rotation sensor 45 each mount to circuit board 84. Circuit board 84 includes electrical paths that interconnect the components of angular position sensor 44 and rotation sensor 45. Additionally, circuit board 84 comprises a malleable material so that inclinometer 78 may be positioned at an angle of approximately 90 degrees relative to inclinometer 77 using bend zone 85. That angular difference between inclinometers 77 and 78 permits inclinometer 77 to measure the movement of mattress 13 from a horizontal to an angular position and inclinometer 78 to measure the rotational movement of mattress 13 about a central horizontal axis.

Referring to FIGS. 1, 2, and 7, circuit board 84 mounts into enclosure 86 using any suitable means, such as an adhesive to protect circuit board 84 and the components of angular position sensor 44 and rotation sensor 45. Enclosure 86 mounts on mattress 13 between, for example, cushions 33 and 34 using any suitable means, such as snaps 88 and 89 or velcro fasteners (see FIG. 7). Alternatively, enclosure 86 could mount underneath frame 11 near the head region of mattress 13 using any suitable means such as screws or nuts and bolts. With angular position sensor 44 and rotation sensor 45 positioned at the head region of mattress 13, any elevation or lowering of mattress 13 or rotation of mattress 13 about its central horizontal axis will be registered. Alternately, enclosure 86 could be mounted under sub-frame 12.

After the initial inflation of cushions 15–36, controller 38 maintains their inflation at the user selected values. However, if a person in therapeutic bed 10 desires to elevate mattress 13 from a horizontal position to an angled position, controller 38 alters the inflation levels of certain cushions to compensate for the change in the weight distribution of the patient's body. Illustratively, as mattress 13 travels to the angled position depicted in FIG. 2, the resistance value of inclinometer 77 changes, resulting in a change in the current level of the signal delivered from angular position sensor 44 to processing unit 42. However, A/D converter 51 first receives that signal and digitizes it into a signal readable by processor unit 42.

Processor unit 42 receives and processes the signal from angular position sensor 44 to determine the necessary control required to supply cushions 15–36 with adequate inflating medium pressure to ensure proper support of the therapeutic bed user. In response to the above signal, processor unit 42 generates a control signal to activate air control valves in air control valve bank 65. Because the buttock region requires inflation during the elevation of mattress 13, processor unit 42 activates the air control valves in air control valve bank 65 which control inflating medium flow to cushions 23–38 (i.e., the buttock region). Consequently, blower 47 increases the inflation within cushions 23–28, but not cushions 15–22 and 28–36. Additionally, because the back region requires deflation during the elevation of mattress 13, processor unit 42 generates control signals to activate the air control valves in air control valve bank 65 which control cushions 29–32. Those air control valves open the fluid lines so that the inflating medium within cushions 29–32 escapes to the atmosphere.

Processor unit 42 maintains the activation of the valves controlling cushions 23–32 as long as it receives a changing signal from angular position sensor 44. Once mattress 13 ceases to elevate, the output signal from angular position sensor 44 returns to a constant value. In response to the constant signal, processor unit 42 adjusts air control valves as necessary to maintain the steady state pressures.

Alternatively, if mattress 13 lowers, the resistance value of inclinometer 77 again changes, resulting in a change in the current level of the signal delivered from angular position sensor 44 to processing unit 42. In response to the above signal, processor unit 42 generates a control signal to activate air control valves in air control valve bank 65. Because only the back region requires inflation during the lowering of mattress 13, processor unit 42 activates the air control valves in air control valve bank 65 which control inflating medium flow to cushions 29–32 (i.e., the back region). Consequently, blower 47 increases the inflation within cushions 29–32, but not cushions 15–28 and 33–36. Because the buttock region requires deflation during the lowering of mattress 13, processor unit 42 generates control signals to activate the air control valves in air control valve bank 65 which control cushions 23–28. Those air control valves open the fluid lines so that the inflating medium within cushions 23–28 escapes to the atmosphere.

Processor unit 42 adjusts air control valves controlling cushions 23–32 as long as it receives a changing signal from angular position sensor 44. Once mattress 13 ceases to elevate, the output signal from angular position sensor 44 returns to a constant value. In response to the constant signal, processor unit 42 adjusts air control valves as necessary to maintain the steady state pressures.

Figure 9:
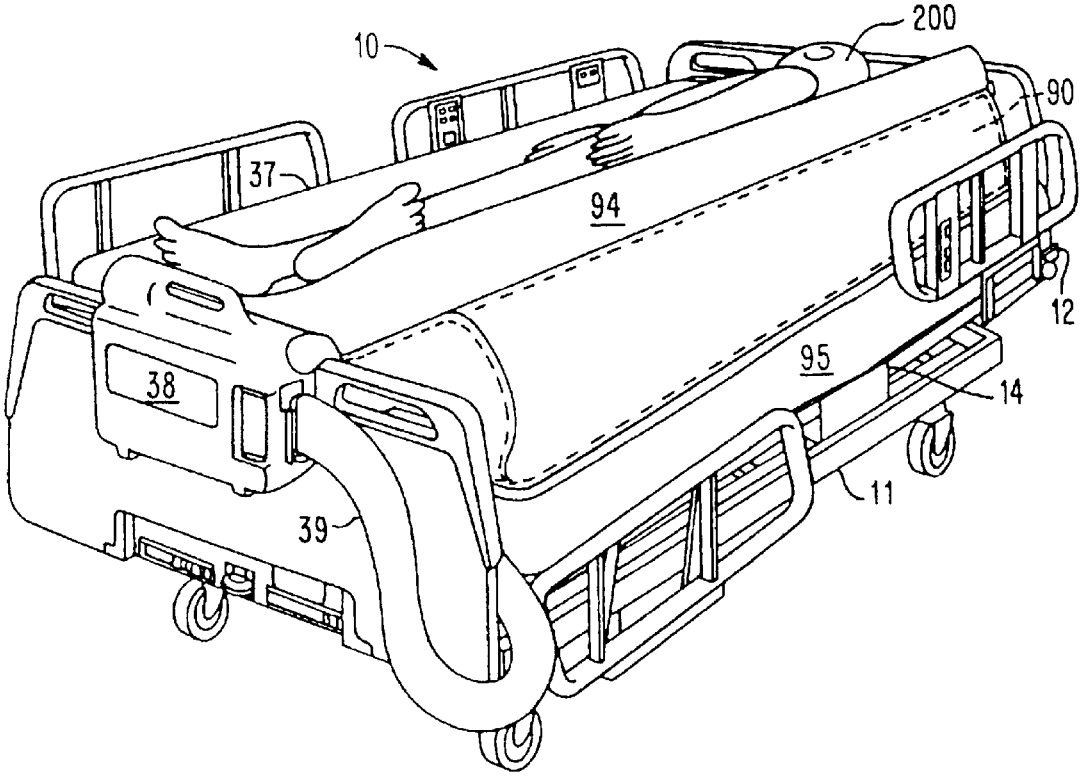
FIG. 9 shows a perspective view of the embodiment of FIG. 8 in use for supporting and turning patient 200.

Referring to FIGS. 8 and 9, an alternative feature of therapeutic bed 10 includes rotation bladders 90 and 91 and guard bladders 92 and 93 (not shown in FIG. 9). Bladders 90 and 91 reside on frame 95 and are positioned underneath the sides of mattress 94 along its entire length. Mattress 94 comprises a similar mattress to mattress 13 except that its cover includes guard bladders 92 and 93 which extend along the entire length of mattress 94.

Figure 11:
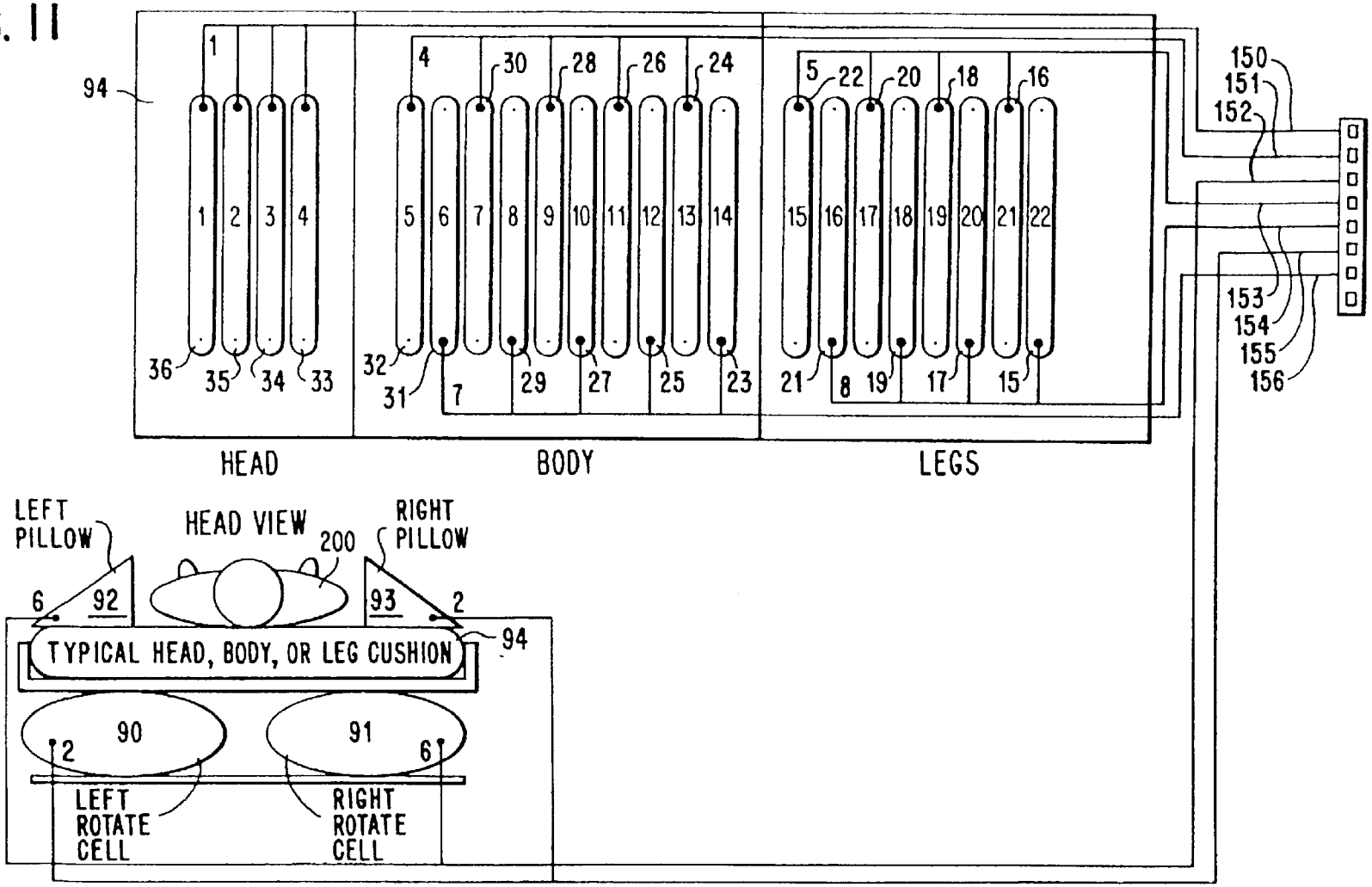
FIGS. 11 and 12 show schematic diagrams of the FIG. 9 and FIG. 10 embodiments, respectively.

Referring to FIG. 11, controller 38 connects to bladders 90 and 91 and guard bladders 92 and 93 via fluid lines 150–156 contained within trunk line 39 to provide an inflating medium to bladders 90 and 91 and guard bladders 92 and 93. The fluid line of bladder 91 is connected to guard rail 92 and the fluid line of bladder 90 is connected to guard rail 93. Processor unit 42 controls the inflation and deflation of bladders 90 and 91 concurrently with guard bladders 93 and 92 to rotate mattress 94 about its central horizontal axis, thereby imparting rotational motion and providing a restraining barrier to the therapeutic bed user. To select mattress rotation, a user pushes rotate button 100 to furnish processor unit 42 with a signal indicating that air control valves in air control valve bank 65 should supply bladders 90 or 91 with the inflating medium.

In response, processor unit 42 generates a control signal that activates air control valves in air control valve bank 65 associated with bladders 90 and 91. However, to produce the rocking motion of mattress 94, processor unit 42 must alternately inflate and deflate bladders 90 and 91. Illustratively, to commence rotation beginning to the left, processor unit 42 generates a control signal to energize the air control valve controlling inflating medium flow to and from bladder 90. As a result, blower 47 delivers the inflating medium to bladder 90, thereby inflating it. Additionally, processor unit 42 generates a control signal to energize the air control valve controlling inflating medium flow to and from bladder 91. However, the actuated air control valve opens the fluid line to bladder 91 to vent any inflating medium in bladder 91 to the atmosphere. With bladder 90 inflated and bladder 91 deflated, mattress 94 rotates to the left. Processor unit 42 generates the air control valve control signals until a predetermined angle is attained, as selected, to ensure the inducement of adequate therapy to the therapeutic bed user. At the attainment of the predetermined angle, after a preset time period, processor unit 42 reverses the energizations of the air control valves to inflate bladder 91 and deflate bladder 90. Thus, processor unit alternately inflates and deflates bladders 90 and 91 to rotate mattress 94 about its central horizontal axis.

One issue to be addressed with rotation of a mattress 94 about its central horizontal axis consists of insuring sufficient inflation of bladders 90 and 91 to provide adequate therapy while also ensuring that patient 200 does not roll off mattress 94. Therapeutic bed 10 includes guard bladders 92 and 93 to restrain the patient and prevent him from falling from mattress 94. Guard bladders 92 and 93 comprise elongated pillows filled with an inflating medium which provide a barrier at the sides of mattress 94 to prevent a bed user from falling from mattress 94 during its rotation.

After commencement of mattress rotation, processor unit 42 must alternately inflate and deflate guard bladders 92 and 93, concurrent with bladders 91 and 90, to restrain the bed user within mattress 94. To properly control the inflation and deflation of bladders 91 and 90 with guard bladders 92 and 93, processing unit 42 must receive signals indicating the rotational position of mattress 94. Thus, controller 38 includes rotation sensor 45 to provide a signal to processor unit 42 which indicates the rotational position of mattress 94. Illustratively, as mattress 94 rotates to the position depicted in FIG. 8, the resistance value of inclinometer 77 changes, resulting in a change in the current level of the signal delivered from rotation sensor 45 to processing unit 42. However, A/D converter 51 first receives that signal and digitizes it into a signal readable by processor unit 42.

Processor unit 42 receives and processes the signal from rotation sensor 45 to determine the necessary control required to inflate and/or deflate the bladder 91/guard rail 92 and bladder 90/guard rail 93 pairs. In this instance, processor unit 42 generates a control signal to activate air control valves in air control valve bank 65 to energize and open the air control valve controlling inflating medium flow to and from bladder 90 with guard bladder 93. Consequently, blower 47 delivers the inflating medium to bladder 90 and guard rail 93, thereby inflating them. Additionally, processor unit 42 generates a control signal to energize the air control valve controlling inflating medium flow to and from bladder 91 with guard rail 92. However, the actuated air control valve opens the fluid line to bladder 91 with guard bladder 92 to vent any inflating medium in bladder 91 and guard bladder 92 to the atmosphere. With bladder 90 and guard bladder 93 inflated and bladder 91 with guard bladder 92 deflated, a barrier on the left side of mattress 94 is formed to prevent a bed user from falling from mattress 94 as the bed surface is rotated to the left.

Processor unit 42 maintains the inflation of bladder 90 with guard bladder 93 and deflation of bladder 19 with guard bladder 92 until it receives a signal from rotation sensor 45 which indicates that the predetermined angle of rotation has been attained. In response to attaining the predetermined angle, after a preset time period, processor unit 42 generates a control signal to energize the air control valve controlling inflating medium flow to and from bladder 91 with guard bladder 92. Consequently, blower 37 delivers the inflating medium to bladder 91 guard bladder 92, thereby inflating them. Additionally, processor unit 42 generates a control signal to energize the air control valve controlling inflating medium flow to and from bladder 90 with guard bladder 93. The actuated air control valve opens the fluid line to bladder 90 and guard bladder 93 to vent the inflating medium within bladder 90 and guard bladder 93 to the atmosphere. With bladder 91 with guard bladder 92 inflated and bladder 90 with guard bladder 93 deflated, a barrier on the right side of mattress 94 is formed to prevent a bed user from falling from mattress 94 as the bed surface is rotated to the right. Thus, processor unit 42 alternately inflates and deflates guard bladders 92 and 93 concurrently with bladders 91 and 90 to form a barrier which prevents a bed user from falling from mattress 94 as the bed surface is rotated to the left and right.

The foregoing description of a primary embodiment provides a detail example of the present invention. Many other embodiments, however, will be evident to those of ordinary skill in the art from the foregoing description, particularly when considered in view of the appended claims and accompanying drawings.

As an example of the alternatives, in one alternative embodiment, the sensors are moved from the central location (of FIG. 1) to the very end of the head section of the mattress. This relocation not only aids in accessing the sensor but also ensures that the sensors do not interfere with the radio-luminescence of the chest section of the mattress. To aid in such relocation, the sensor circuit board 84 is rotated ninety degrees within enclosure 86, and the extending flange 86*a* of enclosure 86 is oriented vertically at the head end of the bed mattress 13. The flange 86*a* can also be extended in length to extend across most of the width of the head end of the bed. In such orientation, the flange 86*a* is removably inserted within an elongate pocket along the perimeter of the head end of the bed. The flange 86*a* then helps provide rigidity to the fabric border surrounding the mattress. The pocket itself is sleeve-like with velcro-like closures at one longitudinal end thereof. Hence, the sensor housing with extended flange is selectively removable from said sleeve-like pouch for servicing the same and for laundering the remainder of the mattress 13. A possible downside of such alternative embodiment relative to the first embodiment is that the sensors are less proximal to the chest of the patient and may not as accurately reflect the angle of rotation of the patient's chest. It is noted that the rotation of the chest is of particular interest because an important benefit of laterally rotating a patient is the prevention and therapy of nosocomial pneumonia, which obviously occurs primarily in the chest region.

Alternative configurations of guard bladders 92 and 93 in such alternative embodiment utilize a semi-rigid support integrated in the outer edge thereof. Such semi-rigid support comprises a section of relatively stiff plastic sheet within an adjacent foam pad adhered thereto. The pad itself is also inserted within rectangular velcro pocket which is formed integral with the flexible perimeter surrounding the mattress. Such perimeter is simply a relatively stiff, upstanding border (or "wall") formed of fabric, much like wall 7*a* described in U.S. Pat. No. 5,267,364.

In addition, the guard bladders 92 and 93 may be relatively short in length as compared to the length of the mattress as a whole. Other restraints and/or support bladders may also be utilized in various portions of the upper surface of the mattress, such as the flexible thoracic packs 37*a*–37*b* shown in FIG. 10. Such packs and other exemplary restraints are described in co-pending application Ser. No. 07/823,281, entitled "Patient Positioners For Use On Oscillating Air Support Surfaces", filed Jan. 21, 1992, now U.S. Pat. No. 5,357,641. For instance, the packs may be secured to a cover sheet that is then secured over inflatable bolsters, and the patient lies directly on such cover sheet. Such cover sheet is fitted with excess material forming pockets for receiving and fitting directly on the inflatable bolsters. Such cover sheet is also provided with flexible thoracic packs having removable velcro straps much as described in said co-pending application.

Figure 10:
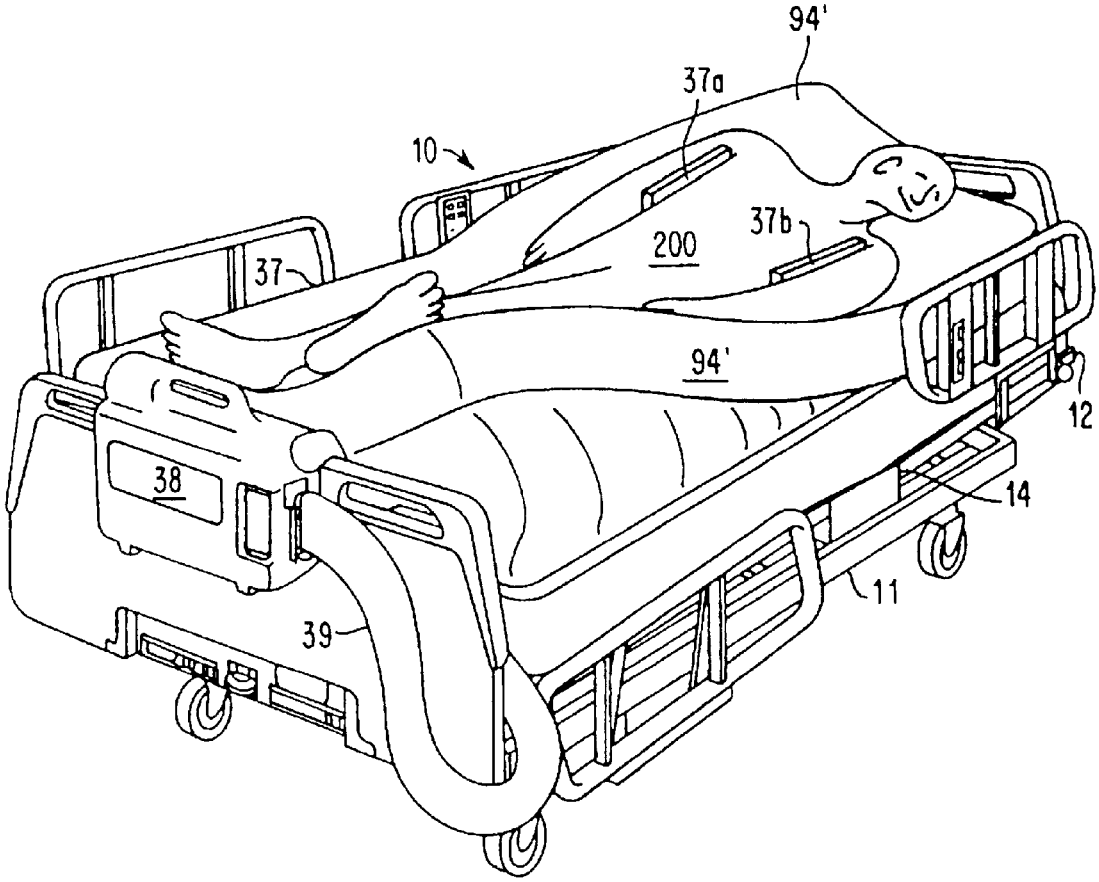
FIG. 10 shows a perspective view of an alternative embodiment.

Although not shown in FIG. 10, releasable clips adjoining opposing straps, much like those described in U.S. Pat. No. 5,267,364, are also utilized in alternative embodiments such as that shown in FIG. 10. In such embodiment, various straps can also be utilized to ensure proper alignment in relationship between turning bladders 90 and 91. Moreover, a side panel 90 may be secured at its lowermost portion by means of a zipper connection with another fabric layer 90*b* that is firmly connected to a base board of frame 11. Screws are utilized in the preferred mode of such embodiment.

In addition, various safety features may also be incorporated into such embodiments. Amongst such safety features are the disabling of the rotation mode in various circumstances, including the lowering of a side rail or the raising of head section 12*a* of frame 11 beyond a comfort zone. Such comfort zone may be up to approximately 60°, or such other level as may be deemed safe while turning a patient from side-to-side to the degree selected.

The independent blower control unit 38 in the first embodiment is eliminated in various alternative embodiments, with its components being integrated into the frame in such alternative embodiments. The blower components and related hardware with connecting pneumatic hoses and the like, are mounted beneath the base boards of the bed in a suitable manner, and the display panel together with its control processor are integrated into the foot board of such alternative frame. Naturally, suitable electrical connections are also made.

Various other features may be added as desired in such alternative embodiments, including scales built in to the frame of such alternative embodiment, percussion controls for selectively controlling the transversely oriented air sacs to percuss the chest region of a patient during rotating modes, and various CPR features for deflating and leveling the patient surface for enabling CPR procedures.

Figure 12:
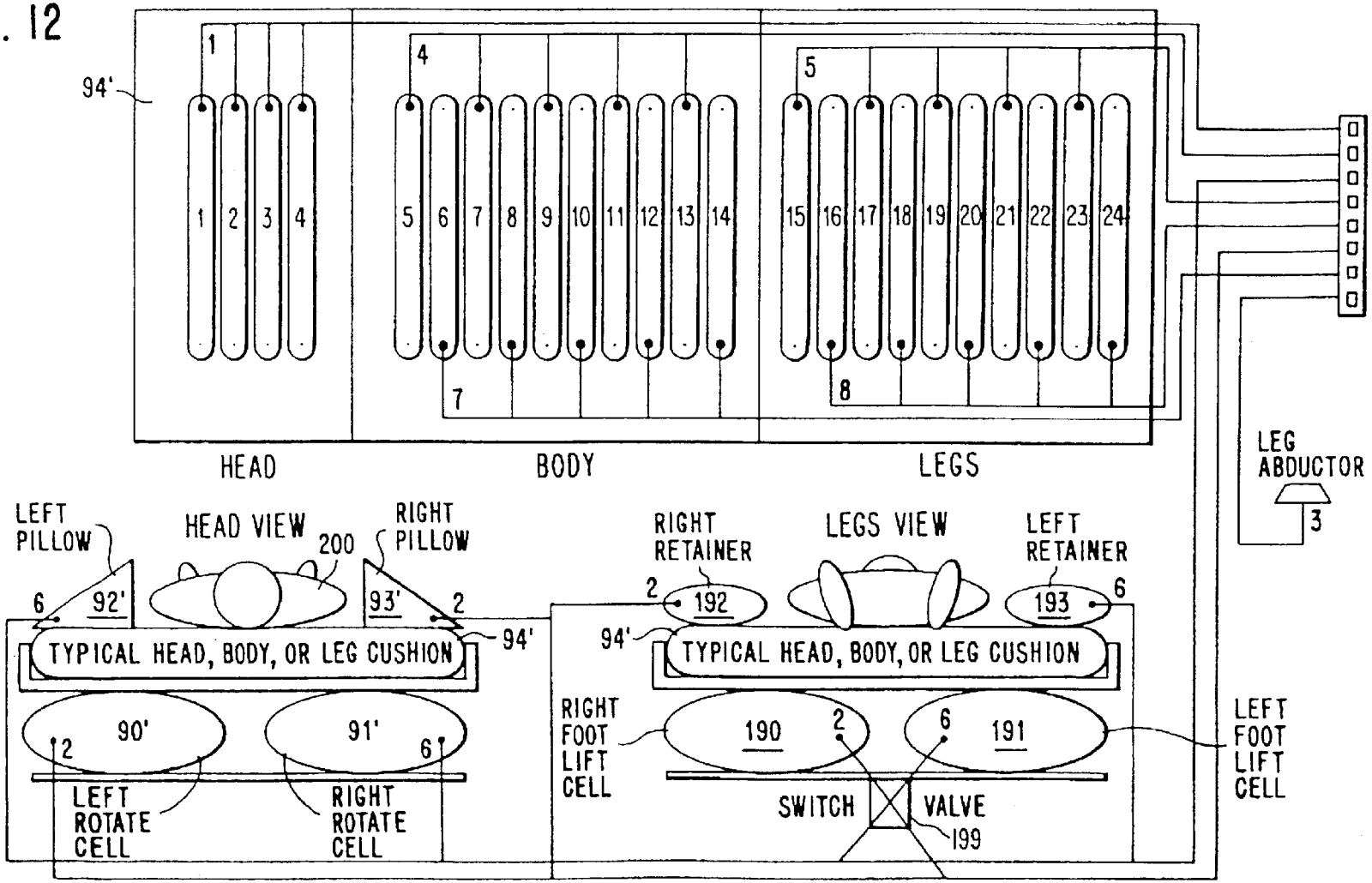

With reference to FIGS. 10 and 12, other aspects of one such alternative embodiment include plumbing which enables counter rotation of the foot section of mattress 94' relative to the head section of mattress 94'. More particularly, rather than a single left rotation bladder and a single right rotation bladder extending the full length of the bed (as shown in FIGS. 9 and 11), two left rotation cells 90 prime and 191 for the head section and leg section of patient 200, respectively, are utilized. Likewise two left pillows and/or retainers 92 prime and 193 are used in combination with two right pillows and/or retainers 192 prime and 93 prime. The plumbing for such alternative embodiment will be evident those of ordinary skill of the art from the schematic diagram shown in FIG. 12. A switch valve 199 is provided to allow selective switching of the configuration shown in FIG. 12 to one more in line with that shown in FIG. 11. Appropriate modification of various retainers, cells and bladders will be evident to those of ordinary skill in the art. Such counter rotation may not only help retain patient 200 on the upper surface of mattress 13', but is believed to also stimulate the lymphatic system of patient 200. Such lymphatic stimulation, or twisting of patient 200 is believed to promote circulation of lymph throughout the lymphatic system of patient 200 by creating pressure differentials on such lymphatic system. Such lymphatic stimulation may be achieved, in part, by turning the head portion of patient 200 to a greater extent that the foot section of patient 200, although greater lymphatic stimulation is thought to result from counter rotation of the foot section relative to the head section of the patient. It addition, the patient may be retained to a greater degree on the top surface of mattress 13' by rotating only the head section thereof and leaving the foot section level, rather than rotating both the head and foot sections in the same direction.

Various prior U.S. Patents and applications have been referenced in certain portions of this disclosure to possibly increase the reader's understanding of the invention and embodiments described and claimed herein. Each of such patents and applications is incorporated herein by this reference as though set forth in their entirety, particularly including (without limitation) U.S. Pat. Nos. 5,267,364, 5,168,589, and application Ser. No. 07/823,281. Further details of such patents have been referenced elsewhere herein.

Although the present invention has been described in terms of the foregoing embodiment, such description has been for exemplary purposes only and, there will be apparent to those of ordinary skill in the art, many alternatives, equivalents, and variations of varying degrees that will fall within the scope of the present invention. That scope, accordingly, is not to be limited in any respect by the foregoing description, rather, it is defined only by the claims which follow.

We claim:

1. An apparatus for measuring the angular position of a patient support surface relative to gravity force, comprising:

a patient support;

an angle sensor mounted to said patient support and having an output responsive to changes in said angle sensor's position relative to gravity force; and said angle sensor comprising circuitry for relating the output therefrom to the change in angular position of said patient support from horizontal to provide a measurement of the angular position of said patient support.

2. The apparatus according to claim 1, said angle sensor comprising;

an enclosure to house said angle sensor;

an inclinometer having output which changes responsively to said inclinometer's positional changes relative to gravitational forces acting thereupon.

3. The apparatus according to claim 1, comprising:

multiple angle sensors having outputs which change responsively to said angle sensor's positional changes relative to gravitational forces acting thereupon; and one or multiple enclosures to house said angle sensors.

4. The apparatus according to claim 3 wherein said angle sensors comprise inclinometers having resistive outputs responsive to positional changes.

5. The apparatus according to claim 4 further comprising:

electrical current sources connected to said inclinometers to convert said inclinometers' outputs to voltages.

6. The apparatus according to claim 1 further comprising:

a second angle sensor mounted to said patient support and having an output responsive to changes in said angle sensor's position relative to gravity force; and circuitry for relating the output therefrom to the change in the angular position of said patient support from horizontal to provide a measurement of the tilt angle of said patient support.

7. The apparatus according to claim 6 wherein said second angle sensor is mounted to said patient support at an angle of approximately 90° relative to said first angle sensor.

8. The apparatus according to claim 7 wherein said patient support surface comprises an inflatable patient support and circuitry responsive to the measurements of angular position and tilt angle for changing the pressure in said inflatable patient support.

9. The apparatus of claim 8 wherein said patient support surface comprises an inflatable patient support surface comprised of multiple sections for supporting respective portions of the body of a patient and circuitry for changing the pressure in each of said sections in response to the measurements of angular position and tilt angle.

10. Apparatus for supporting a patient comprising:

an inflatable patient support comprised of a plurality of separately inflated sections for supporting respective sections of the body of a patient at a desired pressure;

a source for inflating each of the sections of said inflatable patient support to the desired pressure;

an angle sensor mounted to said inflatable patient support and having an output responsive to changes in the position of said inflatable patient support relative to gravity force; and circuitry for changing the pressure in each of the sections of said inflatable patient support in response to the output of said angle sensor as said inflatable patient support rotates from a horizontal to an angular position relative to horizontal.

11. The apparatus for supporting a patient according to claim 10 wherein said angle sensor comprises an inclinometer having a resistive output responsive to positional changes.

12. The apparatus for supporting a patient according to claim 10 wherein said angle sensor is mounted to a planar flange, the planar flange being oriented in a plane which is substantially parallel to the plane on which the patient is supported by said inflatable patient support.

13. The apparatus for supporting a patient according to claim 12 further comprising:

a second angle sensor mounted to said inflatable patient support and having an output responsive to changes in said angle sensor's position relative to gravity force; and circuitry for relating the output therefrom to the change in the angular position of said patient support from horizontal to provide a measurement of the tilt angle of said inflatable patient support along the longitudinal axis of said inflatable patient support.

14. The apparatus for supporting a patient according to claim 13 wherein said second angle sensor is mounted to said inflatable patient support surface at an angle of approximately 90° to said planar flange.

15. The apparatus for supporting a patient according to claim 13 wherein said first and second angle sensors are mounted to a circuit board which is mounted to said planar flange, said circuit board having a bend therein at a point between said first and second angle sensors.

16. The apparatus for supporting a patient according to claim 13 additionally comprising first and second inflatable bladders positioned under said inflatable patient support surface and along the entire length thereof and inflated by said source to desired pressures in response to the output of said circuitry comprising said second angle sensor.

17. A patient support system comprising:

a patient support comprised of multiple sections, each section being adapted for supporting a respective section of the body of a patient;

a first angle sensor mounted to said patient support and having an output responsive to changes in the position of said first angle sensor relative to gravity force;

a second angle sensor mounted to said patient support an angle of approximately 90° relative to said first angle sensor and having an output responsive to changes in the position of said second angle sensor relative to gravity force; and circuitry for relating the outputs of said first and second angle sensors to the change in the position of the patient support surface relative to horizontal and providing outputs measuring any such changes.

18. The apparatus according to claim 17 wherein said first and second angle sensors are mounted to a circuit board having the bend of approximately 90° therein at a point between said first and second angle sensors.

19. The apparatus according to claim 17 wherein said first and second angle sensors comprise inclinometers having resistive outputs responsive to positional changes.

20. The apparatus according to claim 17 further comprising:

a display responsive to said circuitry for providing outputs measuring the changes in the position of the patient support surface relative to horizontal.

* * * * *